US010487770B2

(12) United States Patent
Coppola et al.

(10) Patent No.: US 10,487,770 B2
(45) Date of Patent: Nov. 26, 2019

(54) CYLINDER LINER ASSEMBLY AND METHOD OF MAKING THE SAME

(71) Applicant: GM GLOBAL TECHNOLOGY OPERATIONS LLC, Detroit, MI (US)

(72) Inventors: Anthony M. Coppola, Royal Oak, MI (US); Hamid G. Kia, Bloomfield Hills, MI (US); Peter P. Andruskiewicz, IV, Ann Arbor, MI (US); Michael A. Potter, Grass Lake, MI (US); Paul M. Najt, Bloomfield Hills, MI (US); Russell P. Durrett, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 129 days.

(21) Appl. No.: 15/829,441

(22) Filed: Dec. 1, 2017

(65) Prior Publication Data

US 2019/0170082 A1 Jun. 6, 2019

(51) Int. Cl.

| | |
|---|---|
| ***F02F 1/16*** | (2006.01) |
| ***F02F 1/00*** | (2006.01) |
| ***F02F 1/14*** | (2006.01) |

(52) U.S. Cl.

CPC ..... *F02F 1/16* (2013.01); *F02F 1/004* (2013.01); *F02F 1/14* (2013.01); *F02F 2200/00* (2013.01); *F05C 2253/16* (2013.01)

(58) Field of Classification Search

CPC ..... F02F 1/16; F02F 1/004; F02F 2200/00; F02F 7/0085; F02F 7/007; F02F 1/36; F02F 1/10; F02F 2001/008; B22D 19/009

See application file for complete search history.

(56) References Cited

U.S. PATENT DOCUMENTS

| | | | | |
|---|---|---|---|---|
| 6,044,819 | A | 4/2000 | Rivers et al. | |
| 7,373,873 | B2 | 5/2008 | Maslar | |
| 2016/0341148 | A1* | 11/2016 | Maki | F02F 7/0058 |
| 2018/0030922 | A1* | 2/2018 | Kia | F02F 1/16 |
| 2018/0030923 | A1* | 2/2018 | Coppola | F02F 1/002 |

OTHER PUBLICATIONS

Sara Black, "Composite engine piston cylinder housings", https://www.compositesworld.com/articles/composite-engine-piston-cylinder-housings, accessed Nov. 9, 2017.

* cited by examiner

*Primary Examiner* — Syed O Hasan
(74) *Attorney, Agent, or Firm* — Quinn IP Law

(57) ABSTRACT

A cylinder liner assembly includes an inner wear cylinder, a shell disposed radially outside of an outer surface of the inner wear cylinder, and a central layer disposed between the inner wear cylinder and the shell. The inner wear cylinder is a metal or ceramic, the central layer is a porous material, and the shell is a fiber reinforced polymer. The cylinder liner assembly may include a coolant passage disposed adjacent to the outer surface of the inner wear cylinder, between the inner wear cylinder and the shell. The coolant passage is operable to circulate a coolant therethrough for cooling the inner wear cylinder.

15 Claims, 4 Drawing Sheets

CYLINDER LINER ASSEMBLY AND METHOD OF MAKING THE SAME

INTRODUCTION

The disclosure generally relates to a cylinder liner assembly for an engine block, and a method of manufacturing the cylinder liner assembly.

Engine blocks for internal combustion engines include cylinders that support pistons for reciprocating movement therein. Some engine blocks are formed from cast iron, in which case the cast iron may be machined to define the cylinder bore. In other engine blocks, the engine blocks may be manufactured from some other material, and a cylinder liner installed in the engine block, with the cylinder liner forming the cylinder bore. For example, an engine block may be formed from cast aluminum, and have cast iron cylinder liners installed in the aluminum block to form the cylinder bore. The cast iron cylinder liners provide a wear resistant surface to better resist the wear from the constant reciprocating motion of the pistons against the cylinder wall. Additionally, the cast iron cylinder liners provide better heat resistance to the extreme temperatures that the cylinder walls are exposed to during combustion.

SUMMARY

A cylinder liner assembly for an engine block is provided. The cylinder liner assembly includes an inner wear cylinder. The inner wear cylinder includes an inner surface forming a cylinder bore extending along a central bore axis, and an outer surface. A shell is disposed radially outside of the outer surface of the inner wear cylinder relative to the central bore axis. The shell is a fiber reinforced polymer. A coolant passage is disposed adjacent to the outer surface of the inner wear cylinder, between the inner wear cylinder and the shell. The coolant passage is operable to circulate a coolant therethrough for cooling the inner wear cylinder.

In one aspect of the cylinder liner assembly, the inner wear cylinder is one of a metal or a ceramic material. In another aspect of the cylinder liner assembly, the shell includes one of carbon fibers, glass fibers, basalt fibers, polymeric fibers, or metal fibers.

In one embodiment of the cylinder liner assembly, a central layer is disposed between the inner wear cylinder and the shell. The central layer is a porous material having a plurality of open cells in fluid communication with each other, such that a fluid is capable of circulating through the plurality of open cells. In one embodiment, the plurality of open cells are disposed in fluid communication with the coolant passage. In alternative embodiments, the central layer is formed from a closed cell material.

In one aspect of the cylinder liner assembly, the central layer includes one of a fiber infused polymer, a particle infused polymer, a metal foam, a polymer foam, or an engineered structure.

In one embodiment of the cylinder liner assembly, the central layer defines the coolant passage. In another embodiment, the central layer and the inner wear cylinder cooperate to define the coolant passage. In yet another embodiment, the shell at least partially defines the coolant passage.

In one aspect of the cylinder liner assembly, the coolant passage defines a passage density. The passage density is a volume of the coolant passage per unit length measured axially along the central bore axis. In one embodiment of the cylinder liner assembly, the passage density is variable in different axial regions of the inner wear cylinder along the central bore axis. In other embodiments of the cylinder liner assembly, the passage density is constant throughout a length of the inner wear sleeve along the central bore axis.

In one embodiment of the cylinder liner assembly, the coolant passage includes a plurality of passages. In other embodiments, the coolant passage includes a single passage wrapped around the inner wear cylinder in a spiral configuration.

A method of manufacturing a cylinder liner assembly for an engine block is also provided. The method includes forming an inner wear cylinder to include an inner surface and an outer surface. The inner surface of the inner wear cylinder defines a cylinder bore that extends along a central bore axis. A central layer is formed around the outer surface of the inner wear cylinder. The central layer is formed from a porous material having a plurality of open cells in fluid communication with each other, such that a fluid is capable of circulating through the plurality of open cells. A shell is then formed around an outer surface of the central layer. The shell is formed from a fiber reinforced polymer.

In one embodiment of the method of forming the cylinder liner assembly, a coolant passage is formed adjacent the outer surface of the inner wear cylinder. The coolant passage may be at least partially formed by the central layer.

In another embodiment of the method of forming the cylinder liner assembly, a heat sink is attached to the outer surface of the inner wear cylinder and adjacent a first end of the inner wear cylinder. The heat sink extends radially outward from the central bore axis to a distal circumference. The heat sink may be attached to the inner wear cylinder prior to forming the central layer about the inner wear cylinder.

Accordingly, the cylinder liner assembly described herein provides a lightweight, durable liner for an engine block. The cylinder liner assembly may be installed in a metal engine block, such as a cast iron or cast aluminum engine block. Alternatively, a fiber reinforced engine block may be molded around the cylinder liner assembly. The inner wear cylinder provides heat and wear resistance, while the outer shell provides structural support for the inner wear cylinder. The central layer insulates the shell from the extreme temperatures of the inner wear cylinder. Additionally, the porous structure of the central layer may be used to circulate a coolant therethrough for cooling the inner wear layer. The coolant passage, being disposed immediately adjacent the inner wear cylinder, circulates a coolant immediately adjacent to the inner wear cylinder for cooling the inner wear cylinder.

The above features and advantages and other features and advantages of the present teachings are readily apparent from the following detailed description of the best modes for carrying out the teachings when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Figure 1:
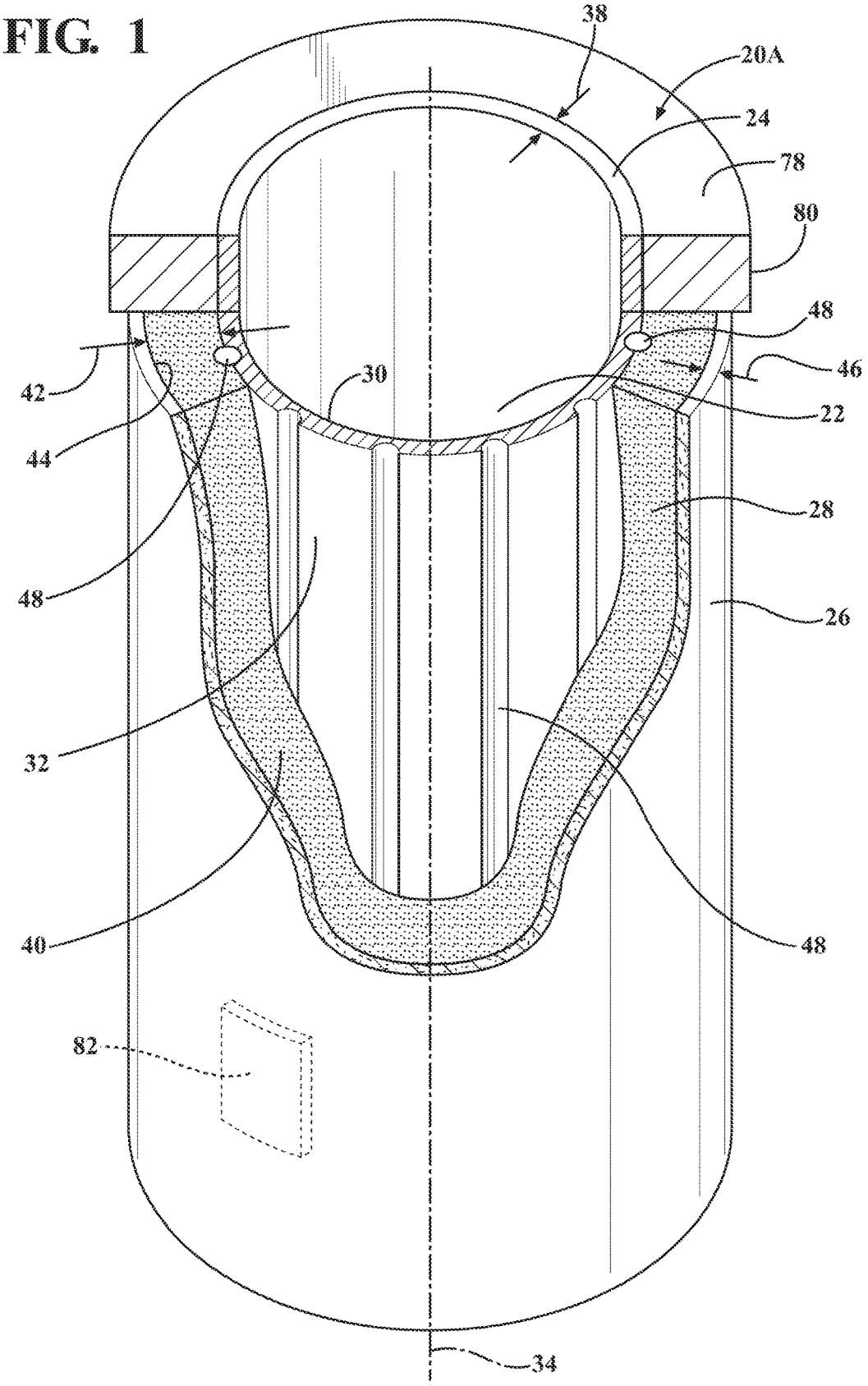
FIG. 1 is a schematic partially cut-away perspective view of a cylinder liner assembly.
Figure 2:
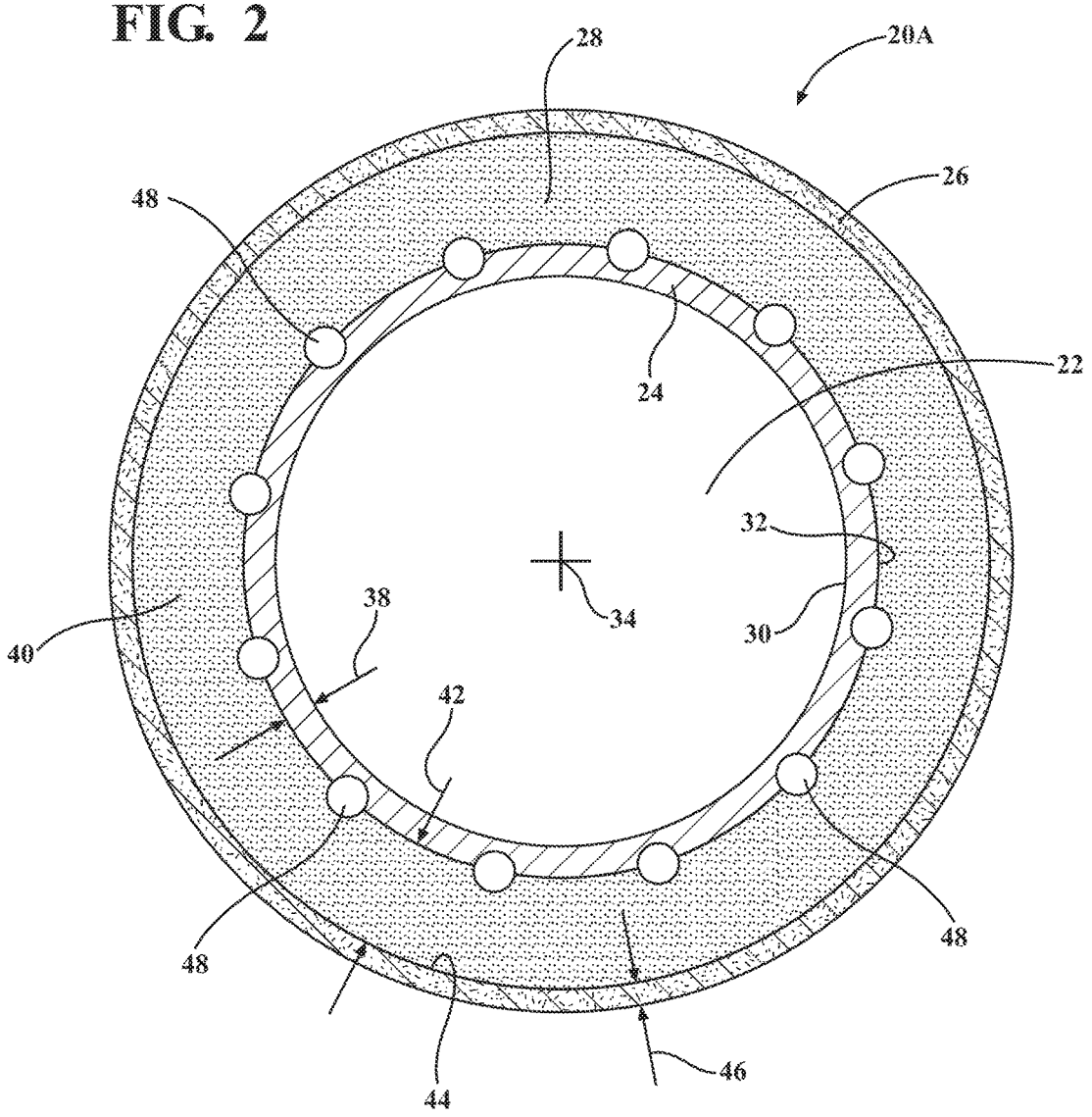
FIG. 2 is a schematic cross sectional view of the cylinder liner assembly.
Figure 3:
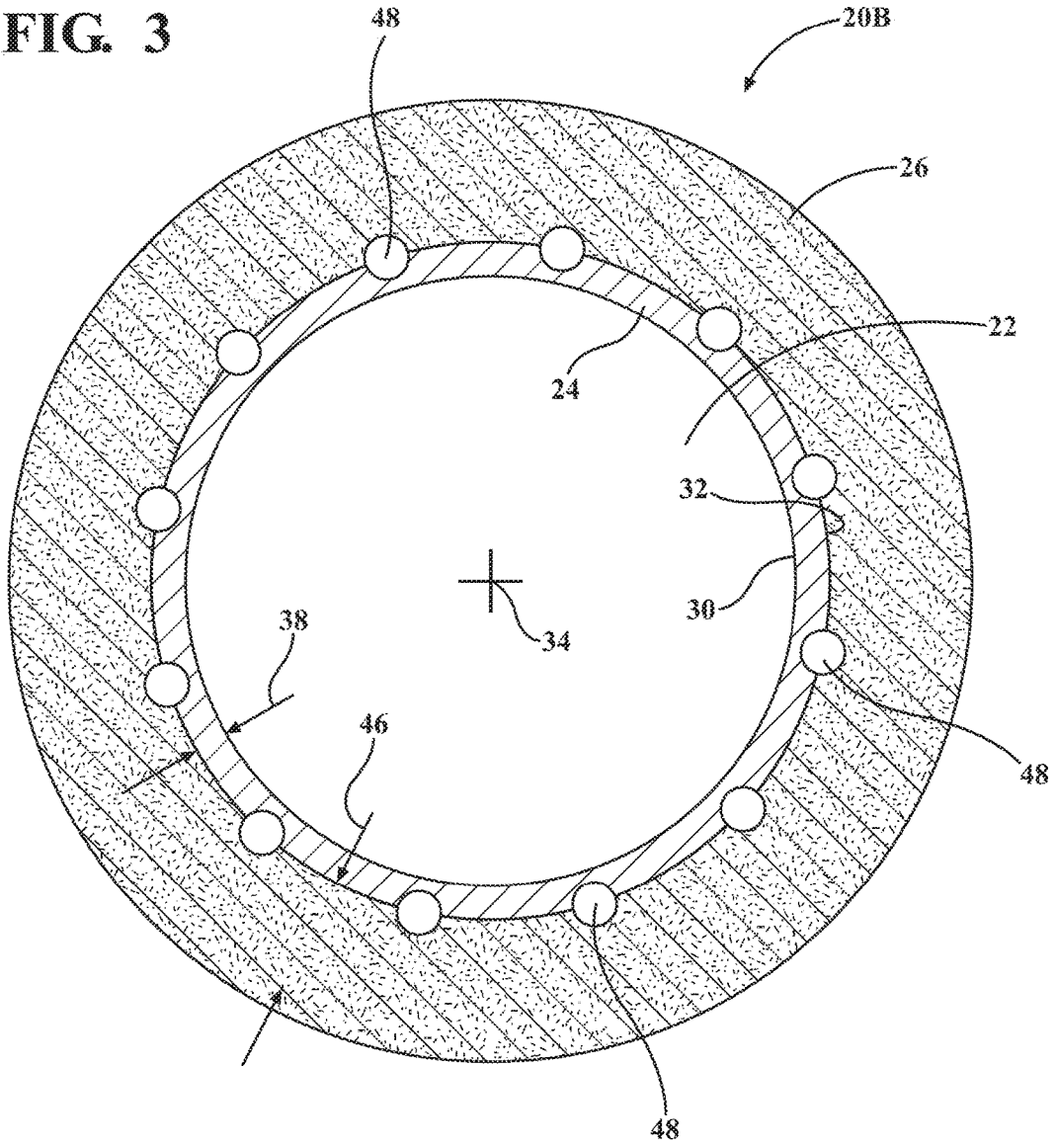
FIG. 3 is a schematic cross sectional view of an alternative embodiment of the cylinder liner assembly.

Referring to the FIGS., wherein like numerals indicate like parts throughout the several views, a first embodiment of a cylinder liner assembly is generally shown at 20A in FIGS. 1 and 2, and a second embodiment of the cylinder liner assembly is generally shown at 20B in FIG. 3. The cylinder liner assembly 20A, 20B may be incorporated into an engine block (not shown) to form a cylinder bore 22. The engine block and cylinder liner assembly 20A, 20B may be configured as a dry liner or a wet liner. As is understood by those in the art, an exterior surface of a dry liner is not directly exposed to engine coolant within the engine block, whereas an exterior surface of a wet liner is directly exposed to engine coolant within the engine block. The engine block supports one or more cylinder liner assemblies as is understood by those skilled in the art. The engine block may include, but is not limited to, a cast iron block, a cast aluminum block, a composite block, a polymer block, or a fiber reinforced polymer block. The engine block may be configured for use with any suitable fuel type, including but not limited to gasoline, diesel fuel, propone, ethanol, compressed natural gas, or combinations thereof.

The cylinder liner assembly 20A, 20B includes an inner wear cylinder 24 and a shell 26. In some embodiments, the cylinder liner assembly 20A may further include a central layer 28 disposed between the inner wear cylinder 24 and the shell 26. The first embodiment of the cylinder liner assembly 20A is shown having the inner wear cylinder 24, the central layer 28, and the shell 26, whereas the second embodiment of the cylinder liner assembly 20B is shown having only the inner wear cylinder 24 and the shell 26.

The inner wear cylinder 24 includes an inner surface 30 and an outer surface 32. The inner surface 30 forms the cylinder bore 22, which extends along a central bore axis 34. In the exemplary embodiments shown, the cylinder bore 22 includes a cylindrical shape that is concentric with the central bore axis 34. The outer surface 32 of the inner wear cylinder 24 is disposed opposite the inner surface 30.

Because the inner wear cylinder 24 forms the cylinder bore 22, which in turn forms a portion of a combustion chamber in which fuel is ignited, the inner wear cylinder 24 is exposed to high temperatures during operation. Accordingly, the inner wear cylinder 24 should be manufactured from a material capable of withstanding high temperatures. Furthermore, it should be appreciated that a piston (not shown) is slideably moveable within the cylinder bore 22. As such, the inner wear cylinder 24 should be manufactured from a material capable of withstanding the wear from the reciprocating movement of the piston.

In the exemplary embodiment shown in the FIGS and described herein, the inner wear cylinder 24 is a very thin layer of a heat resistant and wear resistant material. In some embodiments, the inner wear cylinder 24 includes a wall thickness 38 measured perpendicular to the central bore axis 34 that is between 0.01 mm and 2.00 mm. In other embodiments, the wall thickness 38 is between 0.05 mm and 1.00 mm. In the exemplary embodiment described herein, the inner wear cylinder 24 is one of a metal material or a ceramic material. For example, the inner wear cylinder 24 may be manufactured from metals such as iron, aluminum, steel. Alternatively, the inner wear cylinder 24 may be manufactured from a ceramic material.

As noted above, the central layer 28 is disposed between the inner wear cylinder 24 and the shell 26. The central layer 28 is manufactured from a porous material. The central layer 28 is an insulative layer that is operable to insulate the shell 26 from the high temperatures of the inner wear cylinder 24. In one exemplary embodiment, the porous material used to manufacture the central layer 28 includes a plurality of open cells 40 in fluid communication with each other, such that a fluid is capable of circulating through the plurality of open cells 40. The fluid may include a gas, such as but not limited to air, or a liquid, such as but not limited to an engine coolant (described in greater detail below). The central layer 28 may include a wall thickness 42 measured perpendicular to the central bore axis 34 that is between 0.5 mm and 20.0 mm. In other embodiments, the wall thickness 42 is between 1.0 mm and 10.0 mm.

The central layer 28 may include one of a polymer structure, a metal foam, a polymer foam, or an engineered structure. The central layer 28 may include fibers or particles incorporated therein. Suitable fibers for use in the central layer 28 may include, but are not limited to, glass fibers, carbon fibers, or basalt fibers. Suitable particles for use in the particle infused polymer may include, but are not limited to, glass particles, metal particles, or ceramic particles. The particles may be in the form of solid beads, hollow beads, solid rods, or hollow rods (i.e., tubes). If the central layer 28 includes fibers or particles, then the central layer 28 may be sintered or otherwise bonded together. Suitable polymers that may be used to form the central layer 28 may include, but are not limited to thermoplastics such as but not limited to polyamide, polypropylene, polyamide (thermoplastic), Polyamide-imide, PPS, or PPA, or thermosets such as but not limited to epoxy, phenolic, BMI, polyimide, polyurethane, or silicone. Engineered structures for the central layer 28 may include, but are not limited to, a honeycomb or lattice structure, such as may be specifically designed and formed from a three dimensional printing process or an additive manufacturing process.

The shell 26 is disposed radially outside of the outer surface 32 of the inner wear cylinder 24 relative to the central bore axis 34. If the cylinder liner assembly 20A includes the central layer 28, the shell 26 is further disposed radially outside of an exterior surface 44 of the central layer 28 relative to the central bore axis 34. The shell 26 provides structural support for the inner wear cylinder 24 and the central layer 28 if present. The shell 26 is manufactured and/or formed from a fiber reinforced polymer. Suitable fibers for the shell 26 include, but are not limited to, carbon fibers, glass fibers, basalt fibers, polymeric fibers, or metal fibers. Suitable polymers that may be used to form the shell 26 may include, but are not limited to thermoplastics such as but not limited to polyamide, polypropylene, polyamide (thermoplastic), Polyamide-imide, PPS, or PPA, or thermosets such as but not limited to epoxy, phenolic, BMI, polyimide, -polyurethane, or silicone. The shell 26 may include a wall thickness 46 measured perpendicular to the central bore axis 34 that is between 0.5 mm and 20.0 mm. In other embodiments, the wall thickness 46 of the shell 26 is between 2.0 mm and 8.0 mm.

The cylinder liner assembly 20A, 20B may be formed to include a coolant passage 48. The coolant passage 48 may include a single passage, or a plurality of passages. The coolant passage 48 is operable to circulate a coolant therethrough for cooling the inner wear cylinder 24. When installed in the engine block, the coolant passage 48 is disposed in fluid communication with one or more coolant galleries of the engine block to receive or discharge coolant thereto. As shown in the FIGS, the exemplary embodiments of the cylinder liner assembly 20A, 20B include the coolant passage 48 positioned adjacent to the outer surface 32 of the inner wear cylinder 24, between the inner wear cylinder 24 and the shell 26. Referring to FIGS. 1 and 2, the central layer 28 and the inner wear cylinder 24 cooperate to define the coolant passage 48. Accordingly, the inner wear cylinder 24 is formed to partially define the coolant passage 48, and the central layer 28 is formed to partially define the coolant passage 48. In other embodiments, the central layer 28 may define the entirety of the coolant passage 48. Referring to FIG. 3, the shell 26 at least partially defines the coolant passage 48.

The coolant passage 48 defines a passage density. The passage density is defined herein as a volume of the coolant passage 48 per unit length measured axially along the central bore axis 34. In some embodiments, the passage density may be constant along the central bore axis 34. In other embodiments, the passage density may vary in different axial regions of the inner wear cylinder 24, along the central bore axis 34. For example, Referring to FIGS. 4 through 7, in regions of the inner wear cylinder 24 disposed near an upper or first end 50 of the inner wear cylinder 24, where combustion occurs, the passage density may be higher to provide better cooling of the inner wear cylinder 24. In other regions, farther from the first end 50, that are not subjected to as much heat during combustion as the first end 50 of the inner wear cylinder 24, the passage density may be lower. Accordingly, the amount of cooling provided by the coolant passage 48 for the inner wear cylinder 24 may be optimized for the specific application of the cylinder liner assembly 20A, 20B, and to provide the increased cooling for high temperature regions of the inner wear cylinder 24.

Figure 4:
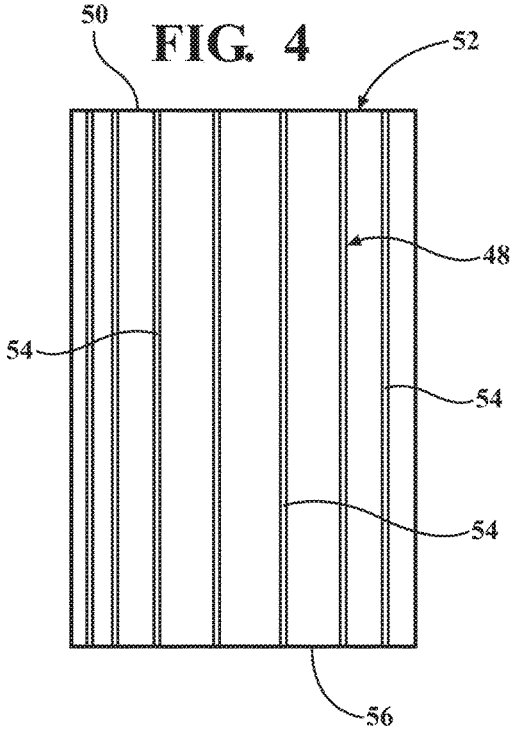
FIG. 4 is a schematic side view of an inner wear cylinder showing a first pattern of a coolant passage.
Figure 5:
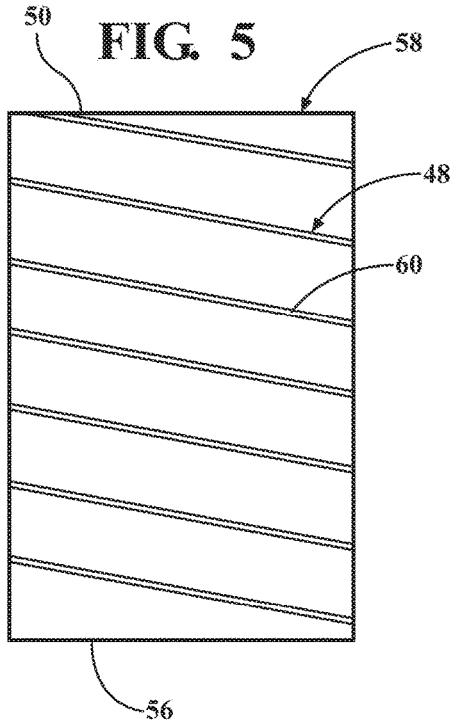
FIG. 5 is a schematic side view of the inner wear cylinder showing a second pattern of the coolant passage.
Figure 6:
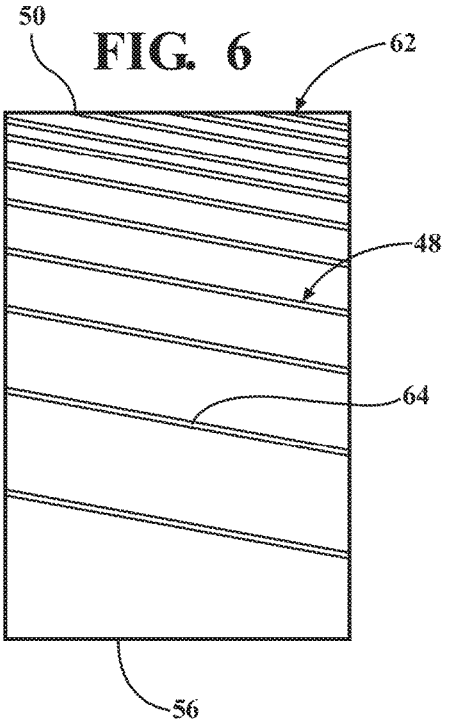
FIG. 6 is a schematic side view of the inner wear cylinder showing a third pattern of the coolant passage.
Figure 7:
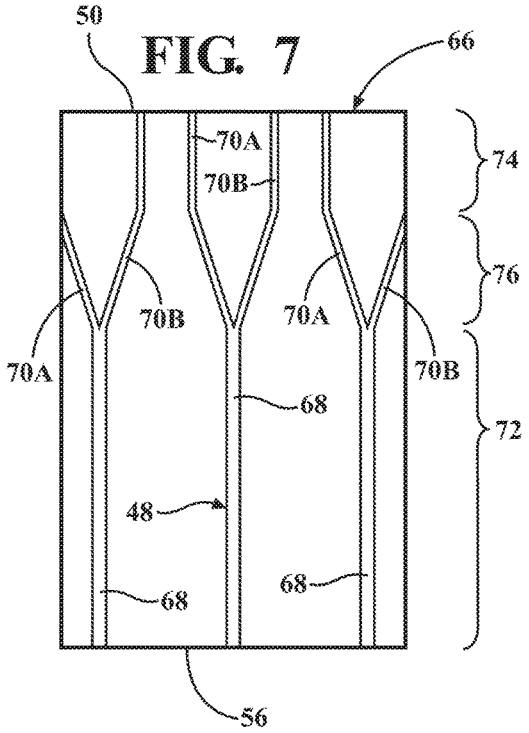
FIG. 7 is a schematic side view of the inner wear cylinder showing a fourth pattern of the coolant passage.

As noted above, the coolant passage 48 may include a single passage, or a plurality of passages. Referring to FIGS. 4 through 7, alternative patterns for the coolant passage 48 are shown. Referring to FIG. 4, a first pattern 52 of the coolant passage 48 is embodied as a plurality of separate passages 54 extending parallel with the central bore axis 34, between the first end 50 of the inner wear cylinder 24 and a second end 56 of the inner wear cylinder 24. The first pattern 52 provides a constant passage density. Referring to FIG. 5, a second pattern 58 of the coolant passage 48 is embodied as a single passage 60 arranged in a spiral configuration, in which the windings of the spiral are spaced a constant distance from each other along the central bore axis 34. The second pattern 58 provides a constant passage density. Referring to FIG. 6, a third pattern 62 of the coolant passage 48 is embodied as a single passage 64 arranged in a spiral configuration, in which the windings of the spiral are spaced at non-constant distances from each other. The third pattern 62 provides a variable passage density, having a higher density at the first end 50 of the inner wear cylinder 24 than at the second end 56 of the inner wear cylinder 24. Referring to FIG. 7, a fourth pattern 66 of the coolant passage 48 is embodied as a plurality of separate passages 68 extending generally parallel with the central bore axis 34, between the first end 50 of the inner wear cylinder 24 and the second end 56 of the inner wear cylinder 24. Each of the separate passages 68 bifurcates to form two sub-passages 70A, 70B for each separate passage 68 near the first end 50 of the inner wear cylinder 24. The fourth pattern 66 provides a variable passage density, having a first region 72 defining a lower first value near the second end 56 of the inner wear cylinder 24, a second region 74 having a higher second value near the first end 50 of the inner wear cylinder 24, and a third region 76 having a variable value disposed between the first region 72 and the second region 74.

In some embodiments, the coolant passage 48 may be disposed in fluid communication with the porous central layer 28, either directly, or indirectly through a coolant gallery of the engine block. Accordingly, the coolant passage 48 may be disposed in fluid communication with the plurality of open cells 40 of the porous material. As such, engine coolant may flow through the coolant passage 48, as well as through the porous material of the central layer 28, in order to provide additional cooling capabilities for the inner wear cylinder 24.

A method of manufacturing the cylinder liner assembly 20A, 20B is also provided. The method includes forming the inner wear cylinder 24 to include the inner surface 30 and the outer surface 32. As noted above, the inner surface 30 defines the cylinder bore 22. The inner wear cylinder 24 may be formed using any suitable process capable of forming the thin walled, inner wear cylinder 24. For example, the inner wear cylinder 24 may be formed using an extrusion process, a casting process, an additive manufacturing process, or a thermal spraying process. Additionally, other machining processes may be included in the formation of the inner wear cylinder 24, such as boring, drilling milling, machining, etc.

A heat sink 78, shown in FIG. 1, may be attached to the outer surface 32 of the inner wear cylinder 24. For example, the heat sink 78 may be attached adjacent to the first end 50 of the inner wear cylinder 24. The heat sink 78 extends radially outward from the central bore axis 34 to a distal circumference 80. The heat sink 78 is operable to transmit heat from the inner wear cylinder 24, outward, away from the inner wear cylinder 24, such as to a coolant gallery in the engine block. The heat sink 78 may include, but is not limited to, a metal, such as aluminum, cast iron, or steel. The heat sink 78 may be attached to the inner wear cylinder 24 in any suitable manner, such as but not limited to a brazing process, press fitting the heat sink 78 onto the inner wear cylinder 24, or casting the heat sink 78 onto the inner wear cylinder 24.

The method may include forming the coolant passage 48 adjacent the outer surface 32 of the inner wear cylinder 24. The coolant passage 48 may be formed using any suitable process, such as placing tubular structures to form the coolant passage 48, or using a lost core process. The lost core process includes attaching a preform for the coolant passage 48 to the inner wear cylinder 24. The preform for the coolant passage 48 has an exterior shape the same size as the coolant passage 48. The preform is attached to the inner wear cylinder 24 in the location on the inner wear cylinder 24 for the desired coolant passage 48. The preform is later removed, leaving a negative impression forming the coolant passage 48. It should be appreciated that the preform is attached to the inner wear cylinder 24 to form the desired pattern of the coolant passage 48.

A layer is then formed around the preform. The layer may include either the central layer 28 or the shell 26. After the layer adjacent the inner wear cylinder 24 has been formed, the preform is removed. The preform may be removed in any suitable manner, such as heating the preform to a melting temperature and draining the preform from the cylinder liner assembly 20A, 20B. Once the preform has been removed, the negative impression left in the layer adjacent the inner wear cylinder 24 defines the coolant passage 48.

As noted above, either the central layer 28 or the shell 26 may be formed adjacent to the inner wear cylinder 24. If included, the central layer 28 is then formed around the outer surface 32 of the inner wear cylinder 24. As noted above, the central layer 28 is formed from a porous material. The porous material may include the plurality of open cells 40 in fluid communication with each other, such that a fluid is capable of circulating through the plurality of open cells 40. The central layer 28 may be formed in any suitable manner, and depends upon the specific material used to form the central layer 28.

Once the central layer 28 has been formed, the outer shell 26 is formed around the exterior surface 44 of the central layer 28. As noted above, the shell 26 is formed from a fiber reinforced polymer. The shell 26 may be formed in any suitable manner, and depends upon the specific material used to form the shell 26. For example, a preform for the shell 26 may be formed using a filament winding or over braiding process as understood by those skilled in the art. The preform for the shell 26 may then be cured as is understood in the art. As noted above, once the shell 26 has been cured, any preforms used to form the coolant passage 48*s* may then be removed.

An accessory 82 may be embedded into the central layer 28 and/or the shell 26. The accessory 82 may include, but is not limited to, an electronic device. For example, the accessory 82 may include, but is not limited to, a sensor, an electrical connector, a thermoelectric generator, a wire harness, an electronic control unit/module, etc. Alternatively, the accessory 82 may include some other device, such as but not limited to, a support bracket for attaching an ancillary component, a threaded insert for receiving a bolt, a threaded stud for receiving a nut, an actuator, an electric motor, etc.

Once the cylinder liner assembly 20A, 20B has been formed, it may be installed into the engine block, as is understood in the art, or may have a polymer engine block formed around the cylinder liner assembly 20A, 20B. As noted above, the cylinder liner assembly 20A, 20B may be a wet liner, in which the shell 26 of the cylinder liner assembly 20A, 20B is disposed in direct contact with engine coolant, or a dry liner, in which the shell 26 of the cylinder liner assembly 20A, 20B is not disposed to direct contact with engine coolant.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

What is claimed is:

1. A cylinder liner assembly for an engine block, the cylinder liner assembly comprising: an inner wear cylinder having an inner surface forming a cylinder bore extending along a central bore axis, and an outer surface; a shell disposed radially outside of the outer surface of the inner wear cylinder relative to the central bore axis, wherein the shell is a fiber reinforced polymer; a coolant passage disposed adjacent to the outer surface of the inner wear cylinder, between the inner wear cylinder and the shell, and operable to circulate a coolant therethrough for cooling the inner wear cylinder; a central layer disposed between the inner wear cylinder and the shell; and wherein the central layer is a porous material having a plurality of open cells in fluid communication with each other, such that a fluid is capable of circulating through the plurality of open cells.

2. The cylinder liner assembly set forth in claim 1, wherein the inner wear cylinder is one of a metal or a ceramic material.

3. The cylinder liner assembly set forth in claim 1, wherein the plurality of open cells are disposed in fluid communication with the coolant passage.

4. The cylinder liner assembly set forth in claim 1, wherein the central layer defines the coolant passage.

5. The cylinder liner assembly set forth in claim 1, wherein the central layer and the inner wear cylinder cooperate to define the coolant passage.

6. The cylinder liner assembly set forth in claim 1, wherein the shell at least partially defines the coolant passage.

7. The cylinder liner assembly set forth in claim 1, wherein the coolant passage defines a passage density, wherein the passage density is a volume of the coolant passage per unit length measured axially along the central bore axis.

8. The cylinder liner assembly set forth in claim 7, wherein the passage density is variable in different axial regions of the inner wear cylinder along the central bore axis.

9. The cylinder liner assembly set forth in claim 7, wherein the coolant passage includes a plurality of passages.

10. The cylinder liner assembly set forth in claim 1, wherein the shell includes one of carbon fibers, glass fibers, basalt fibers, polymeric fibers, or metal fibers.

11. The cylinder liner assembly set forth in claim 1, wherein the central layer includes one of a polymer structure, a metal foam, a polymer foam, or an engineered structure.

12. A cylinder liner assembly for an engine block, the cylinder liner assembly comprising: an inner wear cylinder having an inner surface forming a cylinder bore extending along a central bore axis, and an outer surface; wherein the inner wear cylinder is one of a metal or a ceramic material; a shell disposed radially outside of the outer surface of the inner wear cylinder relative to the central bore axis, wherein the shell is a fiber reinforced polymer; a central layer disposed between the inner wear cylinder and the shell, wherein the central layer is a porous material having a plurality of open cells in fluid communication with each other, such that a fluid is capable of circulating through the plurality of open cells; and a coolant passage disposed adjacent to the outer surface of the inner wear cylinder, between the inner wear cylinder and the shell, and operable to circulate a coolant therethrough for cooling the inner wear cylinder.

13. The cylinder liner assembly set forth in claim 12, wherein the coolant passage is disposed in fluid communication with the plurality of open cells of the central layer.

14. The cylinder liner assembly set forth in claim 12, wherein the coolant passage defines a passage density defined as a volume of the coolant passage per unit length measured axially along the central bore axis, and wherein the passage density is variable in different axial regions of the inner wear cylinder along the central bore axis.

15. A method of manufacturing a cylinder liner assembly for an engine block, the method comprising: forming an inner wear cylinder to include an inner surface defining a cylinder bore extending along a central bore axis, and an outer surface; forming a central layer around the outer surface of the inner wear cylinder from a porous material having a plurality of open cells in fluid communication with each other, such that a fluid is capable of circulating through the plurality of open cells; forming a shell around an outer surface of the central layer from a fiber reinforced polymer; and forming a coolant passage disposed adjacent to the outer surface of the inner wear cylinder, between the inner wear cylinder and the shell, and operable to circulate a coolant therethrough for cooling the inner wear cylinder.

* * * * *